US010577546B2

(12) United States Patent
Choi et al.

(10) Patent No.: US 10,577,546 B2
(45) Date of Patent: Mar. 3, 2020

(54) SYSTEMS AND PROCESSES FOR DEASPHALTING OIL

(71) Applicant: Saudi Arabian Oil Company, Dhahran (SA)

(72) Inventors: Ki-Hyouk Choi, Dhahran (SA); Mazin M. Fathi, Dhahran (SA); Abdullah T. Alabdulhadi, Dhahran (SA)

(73) Assignee: Saudi Arabian Oil Company, Dayton (SA)

( * ) Notice: Subject to any disclaimer, the term of this patent is extended or adjusted under 35 U.S.C. 154(b) by 0 days.

(21) Appl. No.: 15/840,519

(22) Filed: Dec. 13, 2017

(65) Prior Publication Data

US 2018/0187096 A1 Jul. 5, 2018

Related U.S. Application Data

(60) Provisional application No. 62/442,072, filed on Jan. 4, 2017.

(51) Int. Cl.
*C10G 53/06* (2006.01)
*C10L 3/00* (2006.01)
(Continued)

(52) U.S. Cl.
CPC ..... *C10G 53/06* (2013.01); *C10G 21/003* (2013.01); *C10G 21/14* (2013.01); *C10G 31/08* (2013.01);
(Continued)

(58) Field of Classification Search
CPC ..... C10G 21/003; C10G 21/14; C10G 31/08; C10G 53/06; C10G 55/02; C10G 57/00; C10G 2300/206; C10L 3/00
See application file for complete search history.

(56) References Cited

U.S. PATENT DOCUMENTS 3,909,208 A 9/1975 Boret et al.
4,465,888 A 8/1984 Paspek, Jr.
(Continued)

FOREIGN PATENT DOCUMENTS

CA 2938409 A1 8/2015
CN 103180415 A 6/2013
(Continued)

OTHER PUBLICATIONS

Notice of Allowance and Fees Due dated May 14, 2018 pertaining to U.S. Appl. No. 15/374,289.
(Continued)

*Primary Examiner* — Prem C Singh
*Assistant Examiner* — Brandi M Doyle
(74) *Attorney, Agent, or Firm* — Dinsmore & Shohl, LLP

(57) ABSTRACT

Processes for producing deasphalted oil are provided which involve combining a supercritical water stream with a pressurized, heated, hydrocarbon-based composition to create a combined feed stream, introducing the combined feed stream to a supercritical reactor to produce and upgraded product, and depressurizing the upgraded product. The depressurized upgraded product is separated into a light and a heavy fraction, where the heavy fraction has a greater concentration of asphaltene than the light fraction. The light fraction is passed to a separator to separate into a gas fraction, a paraffinic fraction, and a water fraction and the heavy fraction and the paraffinic fraction are combined to remove the asphaltene and produce deasphalted oil. In some embodiments, the paraffinic fraction is dewatered before combining with the heavy fraction.

22 Claims, 4 Drawing Sheets

(51) Int. Cl.

| | |
|---|---|
| ***C10G 57/00*** | (2006.01) |
| ***C10G 21/14*** | (2006.01) |
| ***C10G 55/02*** | (2006.01) |
| ***C10G 21/00*** | (2006.01) |
| ***C10G 31/08*** | (2006.01) |

(52) U.S. Cl.

CPC ..... *C10G 55/02* (2013.01); *C10G 57/00* (2013.01); *C10L 3/00* (2013.01); *C10G 2300/206* (2013.01)

(56) References Cited

U.S. PATENT DOCUMENTS

| | | | | |
|---|---|---|---|---|
| 4,591,426 | A * | 5/1986 | Krasuk | B01J 21/04 208/111.2 |
| 4,822,497 | A | 4/1989 | Hong et al. | |
| 5,387,398 | A | 2/1995 | Mueggenburg et al. | |
| 5,454,950 | A | 10/1995 | Li et al. | |
| 3,039,791 | A | 3/2000 | Kazeef et al. | |
| 6,299,759 | B1 | 10/2001 | Bradway et al. | |
| 6,306,287 | B1 | 10/2001 | Billon et al. | |
| 6,332,975 | B1 | 12/2001 | Abdel-Halim et al. | |
| 6,365,790 | B2 | 4/2002 | Reimer et al. | |
| 7,041,707 | B2 | 5/2006 | Hahn | |
| 7,435,330 | B2 | 10/2008 | Hokari et al. | |
| 7,591,983 | B2 | 9/2009 | Takahashi et al. | |
| 7,594,387 | B2 | 9/2009 | Inage et al. | |
| 7,740,065 | B2 | 6/2010 | Choi | |
| 9,382,485 | B2 | 7/2016 | Choi et al. | |
| 2002/0020359 | A1 | 2/2002 | Boyer et al. | |
| 2005/0040081 | A1 | 2/2005 | Takahashi et al. | |
| 2006/0260927 | A1 | 11/2006 | Abazajian | |
| 2008/0099374 | A1 | 5/2008 | He et al. | |
| 2008/0099376 | A1 | 5/2008 | He et al. | |
| 2008/0099378 | A1 | 5/2008 | He et al. | |
| 2009/0139715 | A1 | 6/2009 | Choi | |
| 2009/0139902 | A1 | 6/2009 | Kressmann et al. | |
| 2009/0159489 | A1 | 6/2009 | Lopez et al. | |
| 2009/0159498 | A1 | 6/2009 | Chinn et al. | |
| 2009/0159504 | A1 | 6/2009 | Choi et al. | |
| 2009/0166262 | A1 | 7/2009 | He et al. | |
| 2011/0147266 | A1 | 6/2011 | Choi | |
| 2012/0061291 | A1 | 3/2012 | Choi et al. | |
| 2012/0061294 | A1 | 3/2012 | Choi et al. | |
| 2012/0181217 | A1 | 7/2012 | Choi et al. | |
| 2013/0140214 | A1 | 6/2013 | Choi | |
| 2013/0206645 | A1 | 8/2013 | Yarbro | |
| 2013/0319910 | A1 | 12/2013 | Koseoglu et al. | |
| 2014/0135540 | A1 | 5/2014 | Iversen | |
| 2014/0251871 | A1 | 9/2014 | Choi et al. | |
| 2014/0275676 | A1 | 9/2014 | Sieli et al. | |
| 2015/0258517 | A1 | 9/2015 | Degaleesan et al. | |
| 2015/0321975 | A1* | 11/2015 | Choi | C07C 4/04 585/400 |
| 2016/0312129 | A1 | 10/2016 | Choi et al. | |
| 2017/0107433 | A1* | 4/2017 | Choi | C10G 9/00 |
| 2017/0166821 | A1* | 6/2017 | Choi | C10G 51/023 |

FOREIGN PATENT DOCUMENTS

| | | | |
|---|---|---|---|
| EP | 1 342 771 | A1 | 9/2003 |
| EP | 1 616 931 | A1 | 1/2006 |
| EP | 1696019 | A1 | 8/2006 |
| GB | 1298904 | A | 12/1972 |
| JP | 2000109850 | | 4/2000 |
| JP | 2003049180 | | 2/2003 |
| KR | 100249496 | B1 | 12/1999 |
| WO | 2008055152 | A1 | 5/2008 |
| WO | 2013033301 | A2 | 3/2013 |
| WO | 2015094948 | A1 | 6/2015 |

OTHER PUBLICATIONS

International Search Report pertaining to PCT International Application No. PCT/US2018/012027, filed Jan. 2, 2018, 5 pages.

Written Opinion pertaining to PCT International Application No. PCT/US2018/012027, filed Jan. 2, 2018, 6 pages.

Final Office Action dated Mar. 16, 2018, pertaining to U.S. Appl. No. 15/374,295, filed Dec. 9, 2016, 13 pages.

Notice of Allowance dated Mar. 22, 2018, pertaining to U.S. Appl. No. 15/374,203, filed Dec. 9, 2016, 8 pages.

Office Action pertaining to U.S. Appl. No. 15/448,913 dated Nov. 13, 2018.

International Search Report dated Mar. 23, 2018 for International Application No. PCT/US2017/068464, filed Dec. 27, 2017, 6 pages.

Written Opinion dated Mar. 23, 2018 for International Application No. PCT/US2017/068464, filed Dec. 27, 2017, 5 pages.

Examination Report pertaining to GCC Patent Application No. 2016/35416, filed Dec. 15, 2016, 3 pages.

Notice of Allowance and Fees(s) Due dated Apr. 9, 2019 pertaining to U.S. Appl. No. 15/448,913, filed Mar. 3, 2017, 11 pgs.

Office Action dated May 3, 2019 pertaining to U.S. Appl. No. 15/448,961, filed Mar. 3, 2017, 46 pgs.

Chinese Office Action dated Jan. 30, 2019 pertaining to CN Application No. 201680077934.2.

Office Action dated Jul. 25, 2019 pertaining to U.S. Appl. No. 16/451,957, filed Jun. 25, 2019, 12 pgs.

Notice of Allowance and Fee(s) Due dated Mar. 4, 2019 pertaining to U.S. Appl. No. 16/049,983, filed Jul. 31, 2018, 7 pgs.

Official Action/Invitation to Respond to Written Opinion dated May 27, 2019 pertaining to Singapore Divisional Patent Application No. 10201902799Q.

Abdulrazak et al., "Problems of Heavy Oil Transportation in Pipelines and Reduction of High Viscosity", Iraqi Journal of Chemical and Petroleum Engineering, 2015, vol. 16, No. 3, 1-9.

Ates et al., "The Role of Catalyst in Supercritical Water Desulfurization", Applied Catalysis B: Environmental, 2014, 147, 144-155, Elsevier B.V.

Badger et al., "Viscosity Reduction in Extra Heavy Crude Oils", 461-465, The Laboratory for Hydrocarbon Process Chemistry, The Pennsylvania State University.

Escallon, Maria M., "Petroleum and Petroleum/Coal Blends as Feedstocks in Laboratory-Scale and Pilot-Scale Cokers to Obtain Carbons of Potentially High Value", A Thesis in Fuel Science, 2008, The Pennsylvania State University Graduate School.

Gateau et al., "Heavy Oil Dilution", Oil & Gas Science and Technology, 2004, vol. 59, No. 5, 503-509.

Hughes et al., "Conocophillips Delayed Coking Process", Handbook of Petroleum Refining Processes, 2003, Chapter 12, 3rd Edition, 12.3-12.31, McGraw-Hill, New York (NY).

International Search Report and Written Opinion pertaining to PCT/US2016/066129 dated Mar. 13, 2017.

International Search Report and Written Opinion pertaining to PCT/US2016/066132 dated Mar. 21, 2017.

International Search Report and Written Opinion pertaining to PCT/US2016/066294 dated Mar. 21, 2017.

Iqbal et al., "Unlocking Current Refinery Constraints", PTQ Q2 2008, www.digitalrefining.com/article/1000682.

Kishita et al., "Desulfurization of Bitumen by Hydrothermal Upgrading Process in Supercritical Water with Alkali", Journal of the Japan Petroleum Institute, 2006, 49 (4), 1779-185.

International Search Report and Written Opinion pertaining to PCT/US2016/066367 dated Nov. 10, 2017.

Office Action pertaining to U.S. Appl. No. 15/374,295 dated Oct. 31, 2017.

Office Action pertaining to U.S. Appl. No. 15/374,203 dated Oct. 31, 2017.

Notice of Allowance pertaining to U.S. Appl. No. 15/377,351 dated Nov. 7, 2017.

Notice of Allowance and Fee(s) Due dated Sep. 16, 2019 pertaining to U.S. Appl. No. 15/448,961 filed Mar. 3, 2017, 23 pgs.

Examination Report dated Aug. 29, 2019 which pertains to GCC Patent Application No. 2018/34570.

Office Action dated Dec. 17, 2019 pertaining to U.S. Appl. No. 15/840,525 filed Dec. 13, 2017, 64 pgs.

(56) References Cited

OTHER PUBLICATIONS

Notice of Allowance and Fee(s) Due dated Dec. 31, 2019 pertaining to U.S. Appl. No. 16/451,957 filed Jun. 25, 2019, 27 pgs.

* cited by examiner

SYSTEMS AND PROCESSES FOR DEASPHALTING OIL

CROSS-REFERENCE TO RELATED APPLICATIONS

This application claims priority to U.S. Provisional Patent Application Ser. No. 62/442,072, filed Jan. 4, 2017, which is incorporated by reference in its entirety.

FIELD OF DISCLOSURE

Embodiments of the present disclosure generally relate to systems and processes for deasphalting oil. Specifically, embodiments of the present disclosure relate to systems and processes for using hydrocarbon products to upgrade heavy oil.

BACKGROUND

The steady increase in the need for refined products has led to a dependency on heavy crude oil to meet the rising demand. Heavy crude oils are available at a significant discount to light, sweet crudes (oils with low hydrogen sulfide and carbon dioxide contents, usually containing less than 0.5% sulfur) and can yield significantly more processable residue.

However, heavy crude oils may contain impurities, and may have a metal content, sulfur content, or aromatic content that is unsuitable in some industrial applications. For these reasons, pretreatment steps to upgrade the heavier crude oil are usually required. The pretreatment methods can be classified into two main groups: solvent extraction, and hydroprocessing.

An example of solvent extraction includes the ROSE® (Residuum Oil Supercritical Extraction) solvent extraction process, developed by Kellogg Brown & Root, Inc. The ROSE process is a solvent deasphalting (SDA) process that separates a resin fraction from asphaltene. However, the ROSE process demonstrates poor conversion of the vacuum residue and thereby is not an economically feasible process. Specifically, to reduce the metal content of the vacuum residue of Arabian heavy crude oil from 250 weight parts per million (wt ppm) to 9 wt ppm by the ROSE process, over 50% of vacuum residue is rejected as asphaltene pitch. Therefore, the ROSE process is not an effective deasphalting oil process because it rejects so much of the vacuum residue.

Hydroprocessing reactions may also be utilized to reduce asphaltene using a supercritical water process. Hydroprocessing uses hydrogenation reactions in the presence of a catalyst and an external supply of hydrogen as a post-treatment process. However, a hydroprocessing unit requires a significant investment and consumes a considerable amount of externally-supplied hydrogen. Additionally, asphaltene present in oil may plug the pores of the catalyst, causing operational problems and increasing costs. Therefore, hydroprocessing is also an ineffective deasphalting oil process.

SUMMARY

Accordingly, a need exists for improved systems for upgrading and deasphalting heavy crude oil.

In accordance with one embodiment of the present disclosure, a process for producing deasphalted oil is provided. The process combines a supercritical water stream with a pressurized, heated hydrocarbon-based composition in a mixing device to create a combined feed stream. The combined feed stream is introduced to a supercritical reactor to produce an upgraded product. The supercritical reactor operates at a temperature greater than the critical temperature of water and a pressure greater than the critical pressure of water. The upgraded product is depressurized and separated into at least one light and one heavy fraction, where the heavy fraction has a greater concentration of asphaltene than the light fraction. The light fraction is passed to a separator and is separated into at least one gas fraction, one paraffinic fraction, and one water fraction. The at least one paraffinic fraction is combined with the heavy fraction to remove asphaltene and thereby produce deasphalted oil.

In accordance with another embodiment of the present disclosure, another process for producing deasphalted oil is provided. The process combines a supercritical water stream with a pressurized, heated hydrocarbon-based composition in a mixing device to create a combined feed stream. The combined feed stream is introduced to a supercritical reactor to produce an upgraded product. The supercritical reactor operates at a temperature greater than the critical temperature of water and a pressure greater than the critical pressure of water. The upgraded product is depressurized and separated into at least one light and one heavy fraction, where the heavy fraction has a greater concentration of asphaltene than the light fraction. The light fraction is passed to an oil/water separator to produce a dewatered light fraction and a water fraction. The dewatered light fraction is passed to a distillation unit to separate it into at least one gas fraction, one dewatered paraffinic fraction, and one dewatered heavy oil fraction. The dewatered paraffinic fraction and the heavy oil fraction are combined to produce at least one deasphalted oil fraction.

BRIEF DESCRIPTION OF THE DRAWINGS

The following detailed description of specific embodiments of the present disclosure can be best understood when read in conjunction with the following drawings, in which.

DETAILED DESCRIPTION

Figure 1:
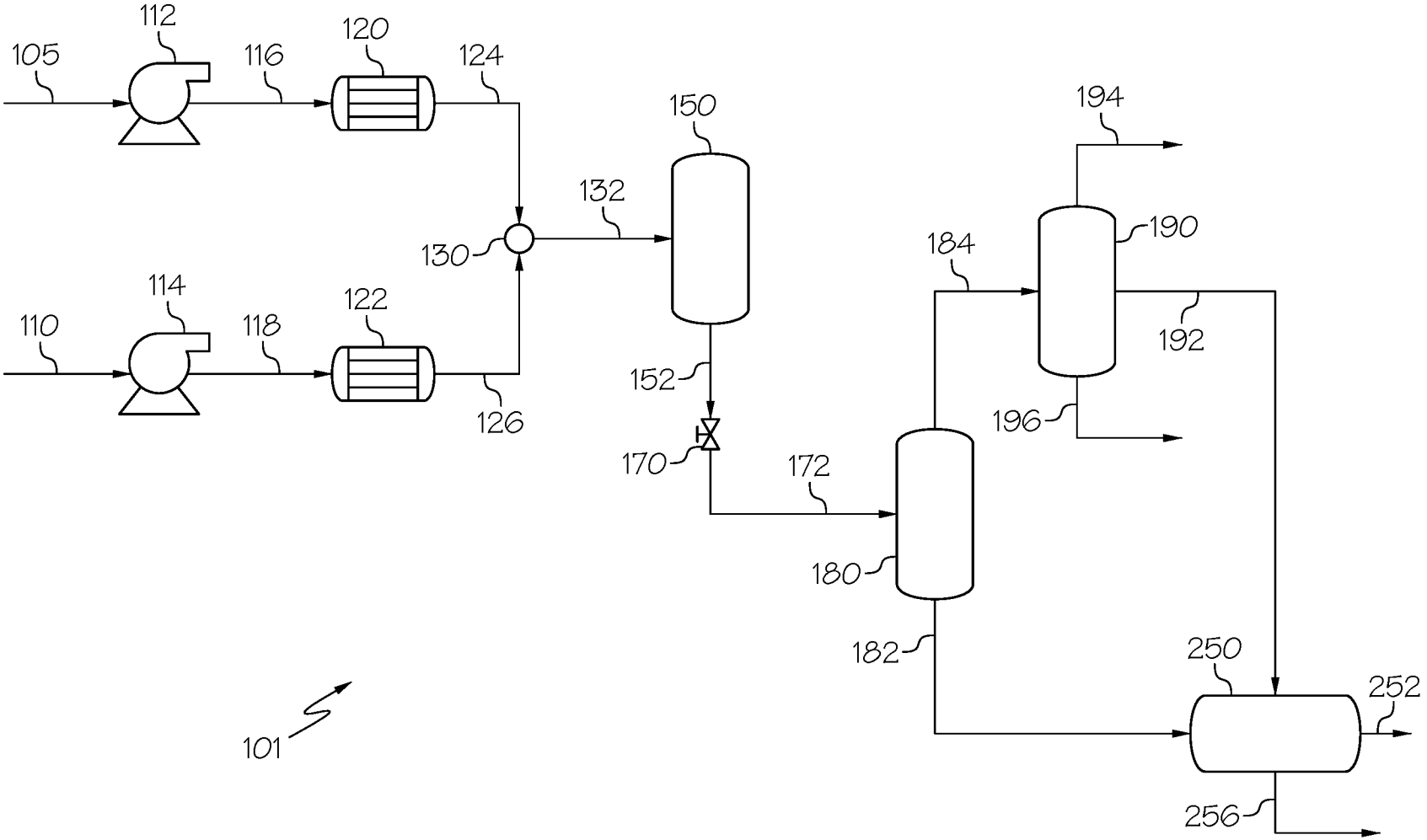
FIG. 1 is a schematic view of a process for deasphalting oil, according to embodiments described.

Embodiments of the present disclosure are directed to processes for deasphalting oils. More specifically, embodiments of the present disclosure are directed to processes for utilizing supercritical water to upgrade and separate hydrocarbon-based compositions to produce deasphalted oil while removing or reducing the need for external solvents, such as external paraffinic solvents and external hydrogen.

Specific embodiments will now be described with references to the figures. Whenever possible, the same reference numerals will be used throughout the drawings to refer to the same or like parts.

FIG. 1 schematically depicts a deasphalting process 101 in which supercritical water is used to remove or reduce the asphaltene content in heavy oil fractions. As used throughout the disclosure, "supercritical" refers to a substance at a pressure and a temperature greater than that of its critical pressure and temperature, such that distinct phases do not exist and the substance may exhibit the diffusion of a gas while dissolving materials like a liquid. As such, supercritical water is water having a temperature and pressure greater than the critical temperature and the critical pressure of water. At a temperature and pressure greater than the critical temperature and pressure, the liquid and gas phase boundary of water disappears, and the fluid has characteristics of both liquid and gaseous substances. Supercritical water is able to dissolve organic compounds like an organic solvent and has excellent diffusibility like a gas. Regulation of the temperature and pressure allows for continuous "tuning" of the properties of the supercritical water to be more liquid-like or more gas-like. Supercritical water has reduced density and lesser polarity, as compared to liquid-phase sub-critical water, thereby greatly extending the possible range of chemistry, which can be carried out in water.

Supercritical water has various unexpected properties as it reaches supercritical boundaries. Supercritical water has very high solubility toward organic compounds and has an infinite miscibility with gases. Furthermore, radical species can be stabilized by supercritical water through the cage effect (that is, a condition whereby one or more water molecules surrounds the radical species, which then prevents the radical species from interacting). Without being limited to theory, stabilization of radical species helps prevent inter-radical condensation and thereby reduces the overall coke production in the current embodiments. For example, coke production can be the result of the inter-radical condensation. In certain embodiments, supercritical water generates hydrogen gas through a steam reforming reaction and water-gas shift reaction, which is then available for the upgrading reactions.

Moreover, the high temperature and high pressure of supercritical water may give water a density of 0.123 grams per milliliter (g/mL) at 27 MPa and 450° C. Contrastingly, if the pressure was reduced to produce superheated steam, for example, at 20 MPa and 450° C., the steam would have a density of 0.079 g/mL. Fluids having a closer density to hydrocarbons may have better dissolution power. Additionally, at that density, the hydrocarbons may interact with superheated steam to evaporate and mix into the liquid phase, leaving behind a heavy fraction that may generate coke upon heating. The formation of coke or coke precursor may plug the lines and must be removed. Therefore, supercritical water is superior to steam in some applications.

FIG. 1 depicts a deasphalting process 101 for producing deasphalted oil 252 by utilizing a supercritical water stream 126. As a brief overview, the deasphalting process 101 combines a supercritical water stream 126 and a pressurized, heated hydrocarbon-based composition 124 in a mixing device 130 to create a combined feed stream 132. The combined feed stream 132 is introduced to a supercritical upgrading reactor 150, which operates at a temperature greater than the critical temperature of water and a pressure greater than the critical pressure of water. The supercritical upgrading reactor 150 produces an upgraded reactor product 152 that is depressurized and separated into a light fraction 184 and a heavy fraction 182. The light fraction 184 is passed to a gas/oil/water separator 190 to separate the light fraction 184 into a gas fraction 194, a paraffinic fraction 192, and a water fraction 196. The paraffinic fraction 192 is combined with the heavy fraction 182 to remove asphaltene from the heavy fraction 182 and thereby produce deasphalted oil 252.

As used throughout the disclosure, "asphaltene" refers to a hydrocarbon composition consisting primarily of carbon, hydrocarbon, nitrogen, oxygen and sulfur, with trace amounts of vanadium and nickel. Without being bound by theory, asphaltene refers to the portion of petroleum that is not dissolved in paraffin solvent (the dissolved portion is referred to as maltene). High boiling point fractions, such as vacuum residue, generally have large concentrations of asphaltene. As mentioned, in some embodiments, the combined feed stream 132 may comprise vacuum residue, atmospheric residue, or combinations thereof. In some embodiments, a vacuum residue fraction may have a true boiling point (TBP) in which 10% of the fraction evaporates at temperatures of greater than or equal to 1050° F.

In some embodiments, the combined feed stream 132 may have an asphaltene content, as measured using n-heptane of greater than 0.1 weight percent (wt %). While there are various definitions regarding what all constitutes asphaltene, it is generally accepted in the industry that n-heptane is an insoluble material that constitutes the majority of the asphaltene fraction. Thus, the asphaltene or n-heptane insoluble content was measured using the American Standard Testing Methodology (ASTM) Standard D3279. In some embodiments, the asphaltene content may be greater than 1 wt %, greater than 5 wt % or greater than 10 wt %. For instance, the asphaltene content in the combined feed stream 132 may be from 0.1 wt % to 1 wt %, or from 0.1 wt % to 3 wt %, or from 0.1 wt % to 5 wt %. The asphaltene content in the combined feed stream 132 may be from 1 wt % to 3 wt %, or from 1 wt % to 5 wt %, or from 3 wt % to 5 wt %. In some embodiments, the ratio of the supercritical water stream 126 to the pressurized, heated hydrocarbon-based composition 124 may be manipulated so as to produce an asphaltene content in the combined feed stream 132 of less than 5 wt %. In some embodiments it may be desirable to reduce the asphaltene content in the combined feed stream 132 to less than or equal to 5 wt % asphaltene to reduce the likelihood of coke formation.

Without intent to be bound by any particular theory, asphaltene may create processing problems, as it can precipitate in crude oil production pipelines, inhibiting pipeline flow. Additionally, asphaltene can also be easily converted to coke if subjected to high temperatures, which may be undesirable and problematic. Asphaltene is often used synonymously with pitch and bitumen; however, while pitch and bitumen contain asphaltene, they may additionally contain other fraction contaminants (such as maltene, a non-asphaltene fraction).

Asphaltene typically includes aromatic cores attached to aliphatic carbon side chains. Without intent to be bound by any particular theory, the increased aromaticity of asphaltene may cause interaction with other aromatic compounds, including multi-ringed compounds. Aromatic bonds exhibit greater bond energy than aliphatic carbon-carbon bonds, and thus are harder to break. While use of supercritical water helps to suppress intermolecular reactions through caging effects, the aromatic moieties may be limited by reaction temperature constraints. Therefore, the side chains present in asphaltene may break away from the aromatic cores while the aromatic moieties remain intact. The aromatic moieties may begin to stack, forming multi-layered aromatic sheets, which may be converted to coke. As mentioned, coke is undesirable and may inhibit pipeline flow or create other processing concerns.

Referring again to FIG. 1, in some embodiments, the hydrocarbon-based composition 105 may comprise whole range crude oil, reduced crude oil, atmospheric distillates, atmospheric residue, vacuum distillates, vacuum residue, cracked product (such as light cycle oil or coker gas oil) or other refinery streams. The hydrocarbon-based composition 105 may be any hydrocarbon source derived from petroleum, coal liquid, or biomaterials. Possible hydrocarbon sources for hydrocarbon-based composition 105 may include whole range crude oil, distilled crude oil, reduced crude oil, residue oil, topped crude oil, product streams from oil refineries, product streams from steam cracking processes, liquefied coals, liquid products recovered from oil or tar sands, bitumen, oil shale, asphaltene, biomass hydrocarbons, and the like. In a specific embodiment, the hydrocarbon-based composition 105 may include atmospheric residue, atmospheric distillates, vacuum gas oil (VGO), vacuum distillates, or vacuum residue. In some embodiments, the hydrocarbon-based composition 105 may include combined streams from a refinery, produced oil, or other hydrocarbon streams from an upstream operation. The hydrocarbon-based composition 105 may be decanted oil, oil containing 10 or more carbons (C10+ oil) or carbon streams from an ethylene plant. The hydrocarbon-based composition 105 may, in some embodiments, be liquefied coal or biomaterial-derivatives such as bio-fuel oil.

The hydrocarbon-based composition 105 may be pressurized in a pump 112 to create a pressurized hydrocarbon-based composition 116. The pressure of pressurized hydrocarbon-based composition 116 may be at least 22.1 megapascals (MPa), which is approximately the critical pressure of water. Alternatively, the pressure of the pressurized hydrocarbon-based composition 116 may be between 22.1 MPa and 35 MPa, such as between 23 MPa and 35 MPa or between 24 MPa and 30 MPa. In some embodiments, the pressure of the pressurized hydrocarbon-based composition 116 may be from 24 MPa to 28 MPa, or from 26 MPa to 30 MPa, or from 25 MPa to 27 MPa.

As shown in FIG. 1, the pressurized hydrocarbon-based composition 116 may be heated in one or more petroleum pre-heaters 120 to form pressurized, heated hydrocarbon-based composition 124. In some embodiments, the pressurized, heated hydrocarbon-based composition 124 may have a pressure greater than the critical pressure of water, as described previously, and a temperature of less than or equal to 150° C. The temperature of the pressurized, heated hydrocarbon-based composition 124 may be between 10° C. and 150° C., or between 50° C. and 150° C., or between 100° C. and 150° C., or between 75° C. and 150° C., or between 50° C. and 100° C. The petroleum pre-heater 120 may be a natural gas fired heater, heat exchanger, an electric heater, or any type of heater known in the art. In some embodiments, the pressurized, heated hydrocarbon-based composition 124 may be heated in a double pipe heat exchanger later in the process.

As shown in FIG. 1, the water stream 110 may be any source of water, such as a water stream 110 having conductivity of less than 1 micro siemens (μS)/centimeters (cm). In some embodiments, the water stream 110 may have a conductivity of less than 0.1 μS/cm or less than 0.05 μS/cm. The water stream 110 may also include demineralized water, distillated water, boiler feed water, and deionized water. In at least one embodiment, water stream 110 is a boiler feed water (BFW) stream. In FIG. 1, water stream 110 is pressurized by pump 114 to produce pressurized water stream 118. The pressure of the pressurized water stream 118 is at least 22.1 MPa, which is approximately the critical pressure of water. The pressure of the pressurized water stream 118 may be from 22.1 MPa to 35 MPa, such as between 23 MPa and 35 MPa or between 24 MPa and 30 MPa. In some embodiments, the pressure of the pressurized water stream 118 may be from 24 MPa to 28 MPa, or from 26 MPa to 30 MPa, or from 25 MPa to 27 MPa.

In FIG. 1, the pressurized water stream 118 may then be heated in a water pre-heater 122 to create a supercritical water stream 126. The temperature of the supercritical water stream 126 is greater than 374° C., which is approximately the critical temperature of water. Alternatively, the temperature of the supercritical water stream 126 may be greater than 380° C. In some embodiments, the temperature may be between 380° C. and 600° C., or between 400° C. and 550° C., or between 380° C. and 500° C., or between 400° C. and 500° C., or between 380° C. and 450° C.

Similar to the petroleum pre-heater 120, suitable water pre-heaters 122 may include a natural gas fired heater, a heat exchanger, and an electric heater. The water pre-heater 122 may be a unit separate and independent from the petroleum pre-heater 120.

Referring again to FIG. 1, the supercritical water stream 126 and the pressurized, heated hydrocarbon-based composition 124 may be mixed in a feed mixer mixing device 130 to produce a combined feed stream 132. The mixing device 130 can be any type of mixing device capable of mixing the supercritical water stream 126 and the pressurized, heated hydrocarbon-based composition 124. In one embodiment, the mixing device 130 may be a mixing tee. The volumetric flow ratio of supercritical water to hydrocarbons fed to the feed mixer may vary. In one embodiment, the volumetric flow ratio may be from 10:1 to 1:10, or 5:1 to 1:5, or 1:1 to 4:1 at standard ambient temperature and pressure (SATP).

In FIG. 1, the combined feed stream 132 may then be introduced to a supercritical upgrading reactor 150 configured to upgrade the combined feed stream 132. The supercritical upgrading reactor 150 may be an upflow, downflow, or horizontal flow reactor. An upflow, downflow or horizontal reactor refers to the direction the supercritical water and petroleum-based composition flow through the supercritical upgrading reactor 150. An upflow, downflow, or horizontal flow reactor may be chosen based on the desired application and system configuration. Without intending to be bound by any theory, in downflow supercritical reactors, heavy hydrocarbon fractions may flow very quickly due to having a greater density, which may result in shortened residence times (known as channeling). This may hinder upgrading, as there is less time for reactions to occur. Upflow supercritical reactors have an increased residence time, but may experience difficulties due to large particles, such as carbon-containing compounds in the heavy fractions, accumulating in the bottom of the reactor. This accumulation may hinder the upgrading process and plug the reactor. Upflow reactors typically utilize catalysts to provide increased contact with the reactants; however, the catalysts may break down due to the harsh conditions of supercritical water, forming insoluble aggregates, which may generate coke. Horizontal reactors may be useful in applications that desire phase separation or that seek to reduce pressure drop, however; the separation achieved may be limited. Each type of reactor flow has positive and negative attributes that vary based on the applicable process.

In FIG. 1, the combined feed stream 132 is introduced through an inlet port of the supercritical upgrading reactor 150. In some embodiments, the combined feed stream 132 may be introduced through an inlet port at the top of the supercritical upgrading reactor 150, at the bottom, or at a side wall in the supercritical upgrading reactor 150, depending on the flow direction, as previously discussed.

The supercritical upgrading reactor 150 may, in some embodiments, be an isothermal or non-isothermal reactor. The reactor may be a tubular-type vertical reactor, a tubular-type horizontal reactor, a vessel-type reactor, a tank-type reactor having an internal mixing device, such as an agitator, or a combination of any of these reactors. Moreover, additional components, such as a stirring rod or agitation device may also be included in the supercritical upgrading reactor 150.

The supercritical upgrading reactor 150 may operate at a temperature greater than the critical temperature of water and a pressure greater than the critical pressure of water. In one or more embodiments, the supercritical upgrading reactor 150 may have a temperature of between 380° C. to 480° C., or between 390° C. to 450° C.

The supercritical upgrading reactor 150 may have dimensions defined by the equation L/D, where L is a length of the supercritical upgrading reactor 150 and D is the diameter of the supercritical upgrading reactor 150. In one or more embodiments, the L/D value of the supercritical upgrading reactor 150 may be sufficient to achieve a superficial velocity of fluid greater than 0.5 meter (m)/minute (min), or an L/D value sufficient to achieve a superficial velocity of fluid between 1 m/min and 5 m/min. The fluid flow may be defined by a Reynolds number greater than 5000.

In some embodiments, the residence time of the internal fluid in the supercritical upgrading reactor 150 may be longer than 5 seconds, such as longer than 1 minute. In some embodiments, the residence time of the internal fluid in the supercritical upgrading reactor 150 may be between 2 and 30 minutes, such as between 2 and 20 minutes or between 5 and 15 minutes or between 5 and 10 minutes.

Referring to FIG. 1, upon exiting the reactor, the pressure of the upgraded reactor product 152 of the supercritical upgrading reactor 150 may be reduced to create a depressurized stream 172, which may have a pressure from 0.05 MPa to 2.2 MPa. The depressurizing can be achieved by many devices, for example, a valve 170 as shown in FIG. 1. Optionally, the upgraded reactor product 152 may be cooled to a temperature less than 200° C. in a cooler (not shown) upstream of the valve 170. Various cooling devices are contemplated for the cooler, such as a heat exchanger.

The depressurized stream 172 may then be fed to a light-heavy separator 180 to separate the depressurized stream 172 into a heavy fraction 182 and a light fraction 184. Various light-heavy separators 180 are contemplated, for example, in some embodiments the light-heavy separator 180 may be a flash drum or distillation unit. In some embodiments, the light-heavy separator 180 may have a temperature controller to control the temperature of the internal fluid comprising the depressurized stream 172. In some embodiments, the temperature controller may be an off-shelf controller. In some embodiments, the light-heavy separator 180 may be a flash drum, which may have a temperature of from 200° C. to 250° C. and a pressure of about 1 atmosphere (ATM).

In some embodiments, the hydrocarbons in the light fraction 184 may have an American Petroleum Institute (API) gravity value that is greater than that of the heavy fraction 182. API gravity is a measure of how heavy or light a petroleum liquid is when compared to water based on the density relative to water (also known as specific gravity). API gravity can be calculated in accordance with Equation 1:

$$API\ \text{GRAVITY} = \frac{141.5}{(\text{Specific Gravity at } 60^\circ\ \text{F.})} - 131.5. \qquad \text{EQUATION 1}$$

API gravity is a dimensionless quantity that is referred to by degrees, with most petroleum liquids falling between 10° and 70°. In some embodiments, the hydrocarbons in the light fraction 184 may have an API gravity value of greater than or to 30°. The hydrocarbons in the light fraction 184 may have an API gravity value from 30° to 40°, 30° to 45°, or from 30° to 50° or from 30° to 70°. In some embodiments, the hydrocarbons in the light fraction 184 may have an API value of greater than or equal to 31°, such as 31.1°. In some embodiments, the hydrocarbons in the light fraction 184 may have an API value of from 40° to 45°, which may be very commercially desirable. In some embodiments, it may be desirable that the hydrocarbons in the light fraction 184 has an API value of less than 45°, as when the API value is greater than 45° the molecular chains may become shorter and the hydrocarbons in the light fraction 184 may be commercially less valuable.

The hydrocarbons in the heavy fraction 182 may have an API gravity value of less than or equal to 30°. For instance, the hydrocarbons in the heavy fraction 182 may have an API gravity value of less than 30° and greater than or equal to 20°. The hydrocarbons in the heavy fraction 182 may have an API gravity value from 22.3° to 30°, or may have an API value of less than 22.3°, such as a value between 10° and 22.3°, or between 10° and 30°. In some embodiments, the hydrocarbons in the heavy fraction 182 may have an API value of less than 10°, such as from 5° to 30° or 1° to 30°, which may be considered "extra" heavy, as oil with an API value of less than 10° sinks in water.

In some embodiments, the true boiling point (TBP) of 80% of the hydrocarbons in the light fraction 184 may be less than 250° C., such as between 100° C. and 250° C. This boiling point range may allow for a greater concentration of paraffins to be present in the hydrocarbons in the light fraction 184. In some embodiments, the TBP of 90% of the hydrocarbons in the light fraction 184 may be less than 250° C., such as between 100° C. and 250° C. or between 150° C. and 250° C.

The hydrocarbons in the heavy fraction 182 may have a greater concentration of asphaltene than those in the light fraction 184. In some embodiments, the hydrocarbons in heavy fraction 182 may have at least 25% more asphaltene than those in the light fraction 184, or may have at least 30%, at least 50%, or at least 75% more asphaltene than those in the light fraction 184. The hydrocarbons in the heavy fraction 182 may have at least 100% or at least 200% or at least 300% or even at least 500% more asphaltene than those in the light fraction 184. The amount of asphaltene in the hydrocarbons in the light fraction 184 and the hydrocarbons in the heavy fraction 182 depends on the content of the combined feed stream 132. In general, the asphaltene content as measured by the content of n-heptane insoluble fraction in the combined feed stream 132 should be greater than 0.1 wt %, or greater than 1 wt %, or greater than 5 wt %, as previously discussed. In general, the amount of asphaltene in the hydrocarbons in the combined feed stream 132 may be about 1 wt % when using Arabian Light Crude Oil and may be about 26 wt % when using vacuum residue from Maya Crude Oil.

In some embodiments, the heavy fraction 182 may have a water content of less than or equal to 5 wt %, such as less than or equal to 3 wt %, or less than or equal to 1 wt %, or less than or equal to 0.1 wt %. The heavy fraction 182 may be dewatered in some embodiments.

Referring again to FIG. 1, the light fraction 184 may be passed to a gas/oil/water separator 190. The gas/oil/water separator 190 may separate the light fraction 184 into a gas fraction 194, a paraffinic fraction 192, and a water fraction 196. In some embodiments, the paraffinic fraction 192 may be combined with the heavy fraction 182 to remove asphaltene 256 and thereby produce deasphalted oil 252.

The gas fraction 194 may be further passed to a caustic treatment unit (not pictured) to remove contaminants, such as hydrogen sulfide ($H_2S$) or mercaptans (R—SH). In some embodiments, the gas fraction 194 may be processed by a caustic treatment unit to produce fuel gas (not pictured). In some embodiments, the caustic treatment unit may use lye, such as sodium hydroxide, to reduce the content of sulfur and other unwanted contaminants present in the gas fraction 194. As used throughout the disclosure, "lye" refers to a strong alkaline solution, such as sodium hydroxide or potassium hydroxide. Hydrogen sulfide is a deadly odorous gas that may be generated during deasphalting processes, such as the deasphalting process 101. Without being bound by any particular theory, hydrogen sulfide may readily dissolve in caustic solutions due to its solubility in high pH conditions, such as a pH of greater than or equal to 10, or from 10 to 12.

As shown in FIG. 1, the paraffinic fraction 192 may be passed to an extractor 250. The extractor 250 may utilize the paraffinic fraction 192 to separate deasphalted oil 252 and asphaltene 256 from the heavy fraction 182. In some embodiments, the process may produce asphaltene 256 at a rate of 14 kilograms per hour (kg/hr). Asphaltene may be produced at a rate of from 10 to 15 kg/hr, or from 12 to 15 kg/hr, or from 15 to 20 kg/hr, or from 15 to 30 kg/hr.

The extractor 250 may be any suitable extractor known in the industry. In some embodiments, the extractor 250 may have a temperature controller to control the temperature of the internal fluid. In some embodiments, the extractor 250 may have a temperature controller to maintain the temperature of the internal fluid such that the paraffinic fraction 192 exists in a liquid phase. In some embodiments, the extractor 250 may have an internal fluid temperature of from 50° C. to 250°. The extractor 250 may have an internal fluid temperature of from 50° C. to 120° C., or from 75° C. to 120° C., or from 100° C. to 200° C., or from 50° C. to 200° C. The temperature controller may be used to maintain the internal fluid temperature within a suitable range, such as from 50° C. to 250° C., as mentioned.

In some embodiments, the extractor 250 may have an internal mixing device. The internal mixing device may be any suitable mixing device. In some embodiments, the internal mixing device may be a rotating agitator, such as a rotating agitator having anchor-type blades. The agitator may further encourage a reaction between the paraffinic fraction 192 and the heavy fraction 182 to produce deasphalted oil 252 and asphaltene 256.

Additionally, to encourage the reaction, in some embodiments the paraffinic fraction 192 and the heavy fraction 182 may have a residence time in the extractor 250 of from 1 minute to 8 hours. In some embodiments, the paraffinic fraction 192 and the heavy fraction 182 may have a residence time in the extractor 250 of at least 10 minutes to allow the paraffinic fraction 192 to act as a solvent, reacting with the heavy fraction 182 to produce deasphalted oil 252. If the asphaltene in the heavy fraction 182 has already precipitated following the light-heavy separation step (which may be caused by a high concentration of paraffins in the light fraction 184), the residence time in the extractor may need to be at least 10 minutes to allow the paraffinic fraction 192 to upgrade the heavy fraction 182 and produce deasphalted oil 252. In some embodiments, the residence time may be from 10 minutes to 30 minutes or from 10 minutes to 60 minutes. In some embodiments, the extractor 250 may have a residence time of from 10 minutes to 45 minutes, or from 10 minutes to 8 hours. The extractor 250 may have a residence time of at least 15 minutes, at least 20 minutes, at 30 minutes, at least 45 minutes, or at least 1 hour.

Without being bound by theory, the supercritical upgrading reactor 150 may crack long paraffin chains attached to aromatics present in the combined feed stream 132 to produce short paraffin chains and aromatic compounds. As used throughout, "long paraffin chain" refers to a hydrocarbon chain comprising greater than or equal to 12 carbons. As used throughout, "short paraffin chain" refers to a hydrocarbon chain comprising less than or equal to 11 carbons. Long paraffin chain compounds may have a boiling point higher than 210° C. (such as $C_{12}H_{26}$, which has a boiling point of about 212° C.) and may have a melting point below 0° C. ($C_{12}H_{26}$ has a melting point of −10° C.).

In some embodiments, the paraffinic fraction 192 may contain a concentration of at least 50 percent by volume (vol %) short chain paraffins. In some embodiments, the paraffinic fraction 192 may contain more than 50 vol % of paraffins. In some embodiments, the paraffinic fraction 192 may contain more than 60 vol % paraffins, such as more than 70 vol %, more than 75 vol %, more than 80 vol %, or more than 90 vol %. The paraffinic fraction 192 may contain from 60 vol % to 100 vol % paraffins, or from 50 vol % to 100 vol % paraffins. The paraffinic fraction 192 may be used as a solvent to remove asphaltene from the heavy fraction 182. Therefore, in some embodiments, a greater paraffin concentration in the paraffinic fraction 192 may lead to better asphaltene separation. A greater paraffin concentration in the paraffinic fraction 192 may lead to the production of more deasphalted oil 252 from the heavy fraction 182, resulting in a more efficient process.

Figure 2:
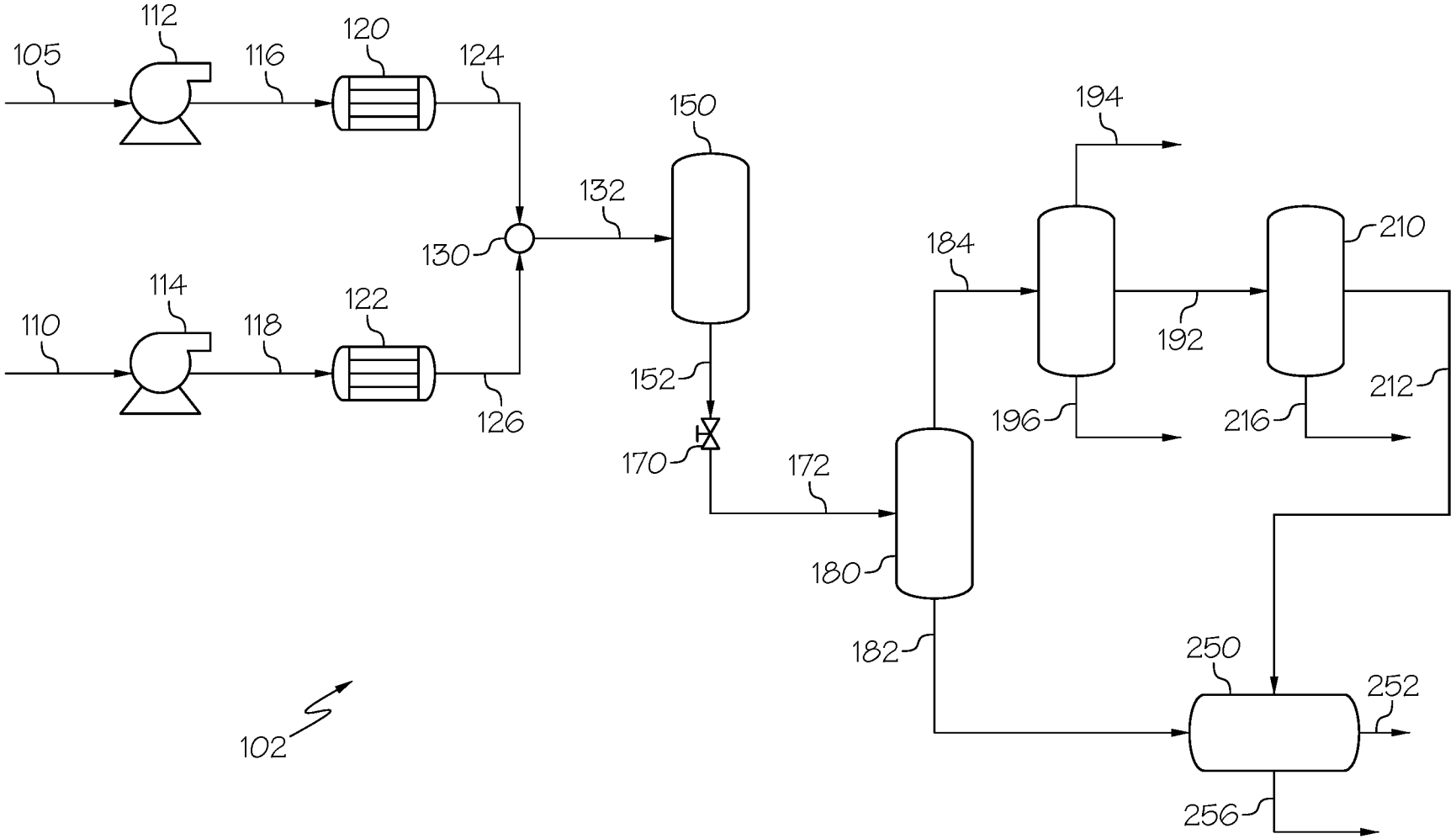
FIG. 2 is a schematic view of a process for deasphalting oil that includes an additional separating step, according to embodiments described.

Referring now to FIG. 2, another deasphalting process 102 is depicted. In FIG. 2, the paraffinic fraction 192 is further processed by a distillation unit 210. It should be understood that the process of FIG. 2 may be in accordance with any of the embodiments previously described with reference to FIG. 1. Like FIG. 1, FIG. 2 depicts a pressurized, heated hydrocarbon-based composition 124 that is combined with a pressurized, supercritical water stream 126 in a mixing device 130 to create a combined feed stream 132, which is fed into a supercritical upgrading reactor 150 to produce an upgraded reactor product 152. The product may be depressurized through a valve 170 to produce a depressurized stream 172, which is separated into at least a heavy fraction 182 and a light fraction 184 by a light-heavy separator 180. The light fraction 184 may be passed to a gas/oil/water separator 190 to separate the light fraction 184 into a gas fraction 194, a paraffinic fraction 192, and a water fraction 196. The gas/oil/water separator 190 may be any separator known in the industry. In some embodiments, the gas/oil/water separator 190 may have a long chamber with multiple outlets to allow for an increased residence time for input fluid so as to allow more separation. In some embodiments, a demulsifier may be added to the gas/oil/water separator 190 to accelerate separation.

In FIG. 2, the paraffinic fraction 192 may be passed to a distillation unit 210 to produce at least a light paraffinic fraction 212 and a heavy paraffinic fraction 216. The light paraffinic fraction 212 may then be combined with the heavy fraction 182 in an extractor 250, as previously discussed, to produce deasphalted oil 252 and asphaltene 256. The light paraffinic fraction 212 may have an increased concentration of paraffins, which may make the light paraffinic fraction 212 more effective as a deasphalting solvent. The light paraffinic fraction 212 may comprise at least 80 vol % paraffins, at least 85 vol % paraffins, at least 90 vol % paraffins, or at least 95 vol % paraffins. The light paraffinic fraction 212 may have a TBP of 80% of the light paraffinic fraction 212 of less than 250° C., such as less than 200° C., less than 150° C., or less than 100° C. Without being bound by theory, removing the aromatic compounds from the light paraffinic fraction 212 may allow the light paraffinic fraction 212 to be a more efficient solvent to convert more of the heavy fraction 182 into deasphalted oil 252. The distillation unit 210 may be in accordance with any distillation units known in the industry.

Figure 3:
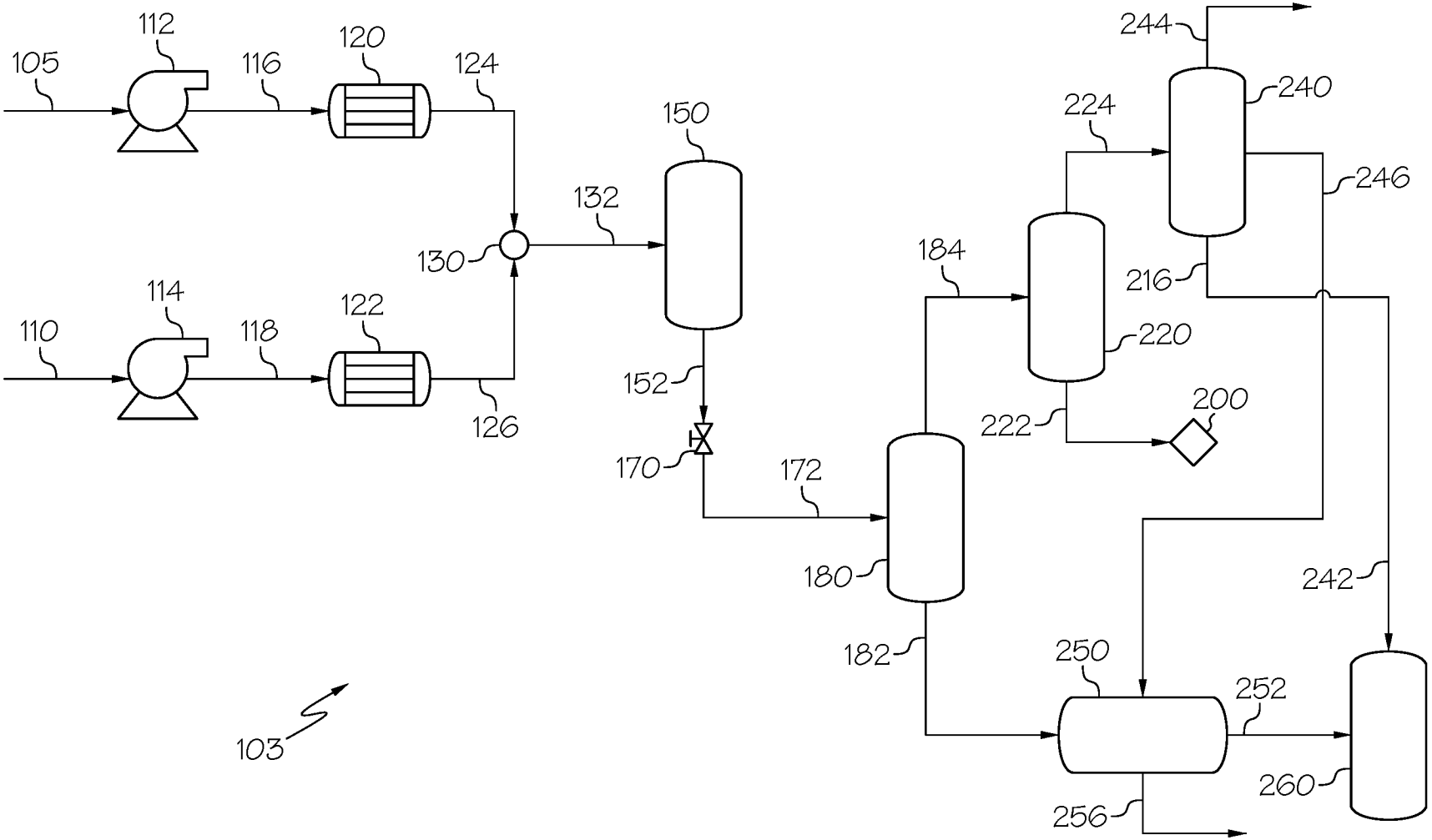
FIG. 3 is a schematic view of another process for deasphalting oil that includes an oil/water separator and a water treatment unit, according to embodiments described.

FIG. 3 depicts another embodiment of a deasphalting process 103, in which the process further comprising an oil/water separator 220 and a water treatment unit 200 for treating the light fraction 184. It should be understood that the process of FIG. 3 may be in accordance with any of the embodiments previously described with reference to FIGS. 1 and 2. Like FIGS. 1 and 2, FIG. 3 depicts a pressurized, heated hydrocarbon-based composition 124 that is combined with a pressurized, supercritical water stream 126 in a mixing device 130 to create a combined feed stream 132, which is fed into a supercritical upgrading reactor 150 to produce an upgraded reactor product 152. The product may be depressurized through a valve 170 to produce a depressurized stream 172, which is separated into at least a heavy fraction 182 and a light fraction 184 by a light-heavy separator 180.

In FIG. 3, the deasphalting process 102 comprises an oil/water separator 220. In FIG. 3, the light fraction 184 is passed to the oil/water separator 220 which removes water from the light fraction 184 to produce a dewatered light fraction 224 and a water fraction 222. The water fraction 222 may be passed to a water treatment unit 200 and the dewatered light fraction 224 may be passed to a separation unit 240.

The water treatment unit may treat the water fraction 222 through any known water treatment processes. The water treatment unit 200 may treat the water fraction 222 in accordance with any traditional water treatment steps, including filtering, deoiling, demineralizing, and adjusting the pH of the water fraction 222. In some embodiments, the water treatment unit 200 may use physical processes, such as settling and filtration, chemical processes such as disinfection and coagulation, biological processes such as slow sand filtration, or any combination of these to treat the water fraction 222. Moreover, the water treatment unit 200 may utilize chlorination, aeration, flocculation, polyelectrolytes, sedimentation, or other techniques known to purify water to treat water fraction 222. In some embodiments, the water fraction 222 may undergo treatment to produce feed water. The feed water may be recycled and used in other processes or used to generate the supercritical water stream 126. The water treatment unit 200 may be in accordance with any known water treatment units known in the industry.

The dewatered light fraction 224 may have a water content of less than or equal to 1 wt % water, such as less than or equal to 0.5 wt % water or less than or equal to 0.1 wt % water. In some embodiments, the dewatered light fraction 224 may have a water content such that the viscosity of the dewatered light fraction 224 is less than or equal to 380 centistokes (cSt), such as less than or equal to 180 cSt.

As shown in FIG. 3, the dewatered light fraction 224 may be passed to a separation unit 240. The separation unit 240 may, in some embodiments, be a distillation unit or an aromatic separator. In some embodiments, the separation unit 240 may separate the dewatered light fraction 224 into a gas fraction 244, a dewatered heavy oil fraction 242 and a dewatered paraffinic fraction 246. The separation unit 240 may have a temperature controller to control the temperature of the internal fluid in the separation unit 240.

The dewatered paraffinic fraction 246 may be combined with the heavy fraction 182. In some embodiments, the dewatered paraffinic fraction 246 may be combined with the heavy fraction 182 in an extractor 250. The extractor 250 may combine the dewatered paraffinic fraction 246 and the heavy fraction 182 to produce deasphalted oil 252 and asphaltene 256. The deasphalted oil 252 may be passed to a product tank 260. Additionally, the dewatered heavy oil 242 may be combined with the deasphalted oil 252, such as in the product tank 260 shown in FIG. 3.

Without being bound by theory, water, as a polar compound, may affect the agglomeration of asphaltene 256. In some embodiments, water may enhance or prevent agglomeration depending on the conditions and the properties of the asphaltene 256. The asphaltene 256 may need to agglomerate to fully separate from maltene in the presence of the paraffinic solvent, such as the dewatered paraffinic fraction 246 and the paraffinic fraction 192. The heavy fraction 182, as previously mentioned, may only contain trace amounts of water, such as less than 2000 wt ppm. In some embodiments, the heavy fraction 182 may contain less than 1000 wt ppm water, or less than 800 wt ppm water, or less than 500 wt ppm water, or less than 100 wt ppm water. This minimal concentration of water may not adversely affect the asphaltene 256 separation.

Figure 4:
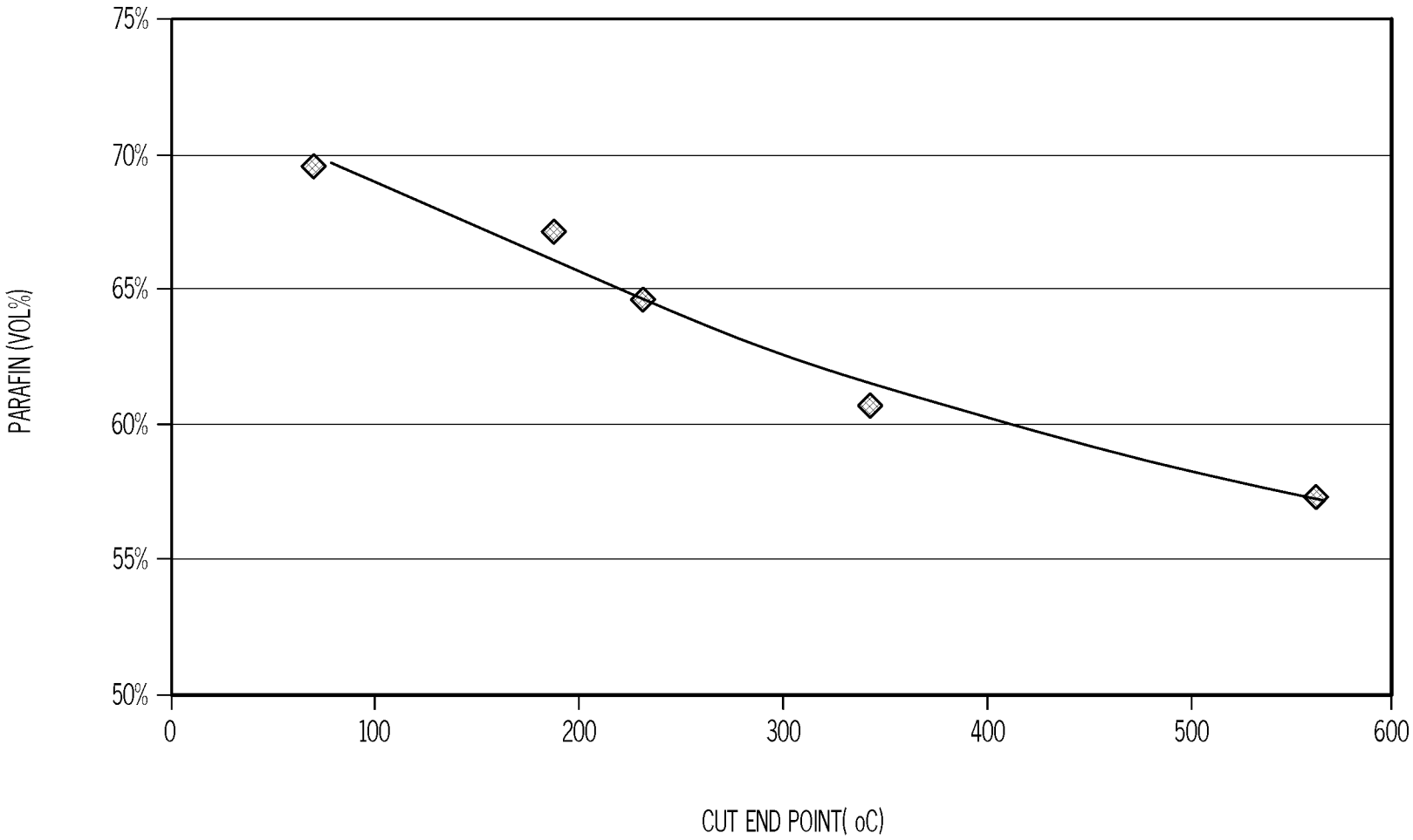
FIG. 4 is a graph of the paraffinic content of fractions based on distillation boiling point ranges.

FIG. 4 is a graph of the paraffinic volume percentage as compared to the cut end point of the fraction in degrees Celsius (° C.). As used throughout, "cut end point" refers to the temperature bounds of a fraction based on the beginning and end points determined from a cumulative true boiling point curve.

As shown in FIG. 4, a true boiling point of less than 100° C. may produce a paraffin vol % of from 68 vol % to 70 vol % and a true boiling point of less than 250° C. may produce a paraffin vol % of greater than 60 vol %. As previously discussed, the paraffinic fraction 192 and the light paraffinic fraction 212 may have a true boiling point of less than 250° C. and may have a paraffin vol % of greater than 60 vol % to ensure proper solubility of asphaltene 256 from the heavy fraction 182.

The following examples illustrate one or more embodiments of the present disclosure as previously discussed. The description of the embodiments is illustrative in nature and is in no way intended to be limiting it its application or use.

EXAMPLES

The following simulation examples illustrate one or more embodiments of the present disclosure previously discussed. Specifically, a simulation, Example 1, was carried out in accordance with the previously described embodiments, particularly with respect to the embodiment of the deasphalting process 103 depicted in FIG. 3. The reaction conditions and constituent properties used in the process are listed in Table 1, listed both by name and by the reference number used in FIG. 3.

Example 1 is a process for deasphalting oil, a hydrocarbon-based (HC-based) composition (comp.) 105 was pressurized in a pump to create a pressurized (pres.) hydrocarbon-based composition 116 with a pressure of 3901 pounds per square inch gauge (psig). A water stream 110 was also pressurized to form a pressurized water stream 118 to a pressure of 3901 psig. The pressurized hydrocarbon-based composition 116 was pre-heated from a temperature of 24° C. to 150° C. The pressurized water stream 118 was also pre-heated from a temperature of 20° C. to a temperature of 450° C. to form a supercritical water stream 126. The supercritical water stream 126 and the pressurized, heated hydrocarbon-based composition 124 were mixed in a feed mixer to produce a combined feed stream 132, which was introduced to a supercritical upgrading reactor to generate an upgraded reactor product 152. The upgraded reactor product 152 (pressure 3901 psig) was depressurized by a valve into depressurized stream 172 (pressure 2 psig). The depressurized stream 172 was fed to a light-heavy separator 180, a flash drum, to separate the depressurized stream 172 into a heavy fraction 182 and a light fraction 184.

The light fraction 184 was then passed to an oil/water separator to separate the light fraction 184 into a dewatered light fraction 224 and a water fraction 222. The dewatered light fraction 224 was passed to a separation unit to produce a gas fraction 194, a dewatered paraffinic fraction 246 and a dewatered heavy oil fraction 242. The dewatered paraffinic fraction 246 was combined with the heavy fraction 182 in an extractor to produce a deasphalted oil fraction 252 and asphaltene 256.

Notably, Example 1 was able to generate deasphalted oil without supplying external energy to the system, without supplying external solvents (such as external paraffins) to the system, and without the need for cooling and reheating the constituents. Example 1 consumed a minimal concentration of water and was able to recycle the water fraction 222. By utilizing so many upgraded, separated components of the combined feed stream 132, Example 1 was able to generate more fuel in a more efficient, self-sustaining system, saving time and money.

TABLE 1

Reaction Conditions and Constituent Properties

| Name<br>Ref. No. | Pres. HC-Based Comp.<br>116 | Pres. Heated HC-Based Comp.<br>124 | Water Stream<br>110 | Pres. Water Stream<br>118 |
|---|---|---|---|---|
| Temperature [° C.] | 24 | 150 | 20 | 23 |
| Pressure [psig] | 3901 | 3901 | 1 | 3901 |
| Mass Flow [kg/h] | 600 | 600 | 661 | 661 |
| Liquid Volume Flow [$m^3$/h] | 0.66 | 0.66 | 0.66 | 0.66 |

| Name<br>Ref. No. | Supercritical Water Stream<br>126 | Combined Feed Stream<br>132 | Reactor Product<br>152 | Depres. Stream<br>172 |
|---|---|---|---|---|
| Temperature [° C.] | 450 | 393 | 450 | 353 |
| Pressure [psig] | 3901 | 3901 | 3901 | 2 |
| Mass Flow [kg/h] | 661 | 1261 | 1261 | 1261 |
| Liquid Volume Flow [$m^3$/h] | 0.66 | 1.32 | 1.51 | 1.51 |

| Name<br>Ref. No. | HC-Based Comp.<br>105 | Light Fraction<br>184 | Heavy Fraction<br>182 | Dewatered Light Fraction<br>224 | Water Fraction<br>222 | Gas Fraction<br>244 |
|---|---|---|---|---|---|---|
| Temperature [° C.] | 25 | 270 | 270 | 30 | 30 | 921 |
| Pressure [psig] | 0 | 2 | 2 | 2 | 2 | 1 |
| Mass Flow [kg/h] | 600 | 1170 | 91 | 513 | 657 | 10 |
| Liquid Volume Flow [$m^3$/h] | 0.66 | 1.41 | 0.10 | 0.75 | 0.66 | 0.13 |
| Petroleum Property (API) | 23.9 | N/A | 21.3 | 75 | N/A | N/A |
| Petroleum Property (TBP 5%) | 315 | N/A | 372 | N/A | N/A | N/A |
| Petroleum Property (TBP 10%) | 363 | N/A | 387 | N/A | N/A | N/A |
| Petroleum Property (TBP 30%) | 375 | N/A | 447 | N/A | N/A | N/A |
| Petroleum Property (TBP 50%) | 413 | N/A | 564 | 200 | N/A | N/A |
| Petroleum Property (TBP 70%) | 450 | N/A | 567 | 370 | N/A | N/A |
| Petroleum Property (TBP 90%) | 568 | N/A | 583 | 411 | N/A | N/A |
| Petroleum Property (Sulfur wt %) | 2.8 | N/A | 2.1 | 1.1 | N/A | 1.3 |
| Petroleum Property (Paraffins by Volume) | 19 | N/A | 18 | 58 | N/A | N/A |
| Petroleum Property (Naphthenes by Volume) | 40 | N/A | 47 | 21 | N/A | N/A |
| Petroleum Property (Aromatics by Volume) | 40 | N/A | 34 | 18 | N/A | N/A |

TABLE 1-continued

| Reaction Conditions and Constituent Properties | | | | | | |
|---|---|---|---|---|---|---|
| Water Content (wt %) | — | 56.5 | 0.1 | 0.7 | 99.5 | — |
| C7-Asphalthene (wt %) | 2.5 | — | 2.5 | — | — | — |

| Name<br>Ref. No. | Dewatered Paraffinic Fraction<br>246 | Dewatered Heavy Oil and Deparaffinated Light Oil<br>242 | Deasphalted Oil<br>252 | Dewatered Heavy Fraction 242 and Deasphalted Oil 252 Combined Product |
|---|---|---|---|---|
| Temperature [° C.] | 20 | 20 | 20 | 20 |
| Pressure [psig] | 1 | 1 | 1 | 1 |
| Mass Flow [kg/h] | 48 | 411 | 125 | 536 |
| Liquid Volume Flow [$m^3$/h] | 0.07 | 0.55 | 0.15 | 0.70 |
| Petroleum Property (API) | 65.7 | 56.8 | 26.2 | 32.1 |
| Petroleum Property (TBP 5%) | N/A | N/A | 314 | — |
| Petroleum Property (TBP 10%) | N/A | N/A | 342 | 157 |
| Petroleum Property (TBP 30%) | 27 | 173 | 405 | 203 |
| Petroleum Property (TBP 50%) | 86 | 363 | 417 | 370 |
| Petroleum Property (TBP 70%) | 107 | 377 | 463 | 383 |
| Petroleum Property (TBP 90%) | 112 | 434 | 508 | 429 |
| Petroleum Property (Sulfur wt %) | 0.1 | 1.2 | 1.0 | 1.1 |
| Petroleum Property (Paraffins by Volume) | 83 | 40 | 23 | 42 |
| Petroleum Property (Naphthenes by Volume) | 12 | 35 | 45 | 34 |
| Petroleum Property (Aromatics by Volume) | 5 | 25 | 32 | 24 |
| Water Content (wt %) | <0.1 | 0.9 | | <0.1 |
| C7-Asphalthene (wt %) | 0 | 0 | 0.1 | — |

Table 1 shows the conditions, properties, and compositions of each of the listed components in the deasphalting process 103. It should be understood that some properties will not be applicable to all fractions, for instance, API and other petroleum properties do not apply to the water fraction 222 and the light fraction 184, which contains a majority of water (about 56.5%).

As noted in the headings listed in Table 1, some components were sampled and tested after further processing or combining. For instance, a portion of the Dewatered Heavy Oil Stream 242 was deparaffinated into a light oil stream. Similarly, a portion of the Dewatered Heavy Oil Stream 242 was combined with the Deasphalted Oil Stream 252 to produce a Combined Product. The properties of the Light Oil and Combined Product are shown in Table 1.

A first aspect of the disclosure is directed to a process for producing deasphalted oil, the process comprising: combining a supercritical water stream with a pressurized, heated hydrocarbon-based composition in a mixing device to create a combined feed stream; introducing the combined feed stream into a supercritical reactor, where the supercritical reactor operates at a temperature greater than a critical temperature of water and a pressure greater than a critical pressure of water, to produce an upgraded product; depressurizing the upgraded product; separating the depressurized upgraded product into at least one light and at least one heavy fraction, in which the heavy fraction has a greater concentration of asphaltene than the light fraction; passing the light fraction to a separator to separate the light fraction into at least one gas fraction, one paraffinic fraction, and one water fraction; and combining the paraffinic fraction with the heavy fraction to remove asphaltene and thereby produce deasphalted oil.

A second aspect of the disclosure includes the first aspect, where hydrocarbons in the light fraction have an American Petroleum Institute (API) gravity value that is greater than hydrocarbons in the heavy fraction.

A third aspect of the disclosure includes the first or second aspects, where the heavy fraction has at least a 25% greater concentration of asphaltene than the light fraction.

A fourth aspect of the disclosure includes any of the first through third aspects, where the heavy fraction has at least a 75% greater concentration of asphaltene than the light fraction.

A fifth aspect of the disclosure includes any of the first through fourth aspects, where the heavy fraction has a greater boiling point than the light fraction.

A sixth aspect of the disclosure includes any of the first through fifth aspects, further comprising cooling the upgraded product before the depressurizing step.

A seventh aspect of the disclosure includes any of the first through sixth aspects, where hydrocarbons in the light fraction have an API gravity value of greater than or equal to 30° and hydrocarbons in the heavy fraction have an API gravity value of less than 30°.

An eighth aspect of the disclosure includes any of the first through seventh aspects, where hydrocarbons in the heavy fraction have an API gravity value of less than 30° and greater than or equal to 20°.

A ninth aspect of the disclosure includes any of the first through eighth aspects, further comprising passing the water fraction to a water treatment unit to produce a feed water fraction.

A tenth aspect of the disclosure includes any of the first through ninth aspects, where separating the depressurized upgraded product comprises passing the depressurized upgraded product to at least one distillation unit.

An eleventh aspect of the disclosure includes any of the first through tenth aspects, where separating the depressurized upgraded product comprises passing the depressurized upgraded product to a flash drum.

A twelfth aspect of the disclosure includes any of the first through eleventh aspects, where combining the paraffinic fraction and the heavy fraction is performed using an extractor.

A thirteenth aspect of the disclosure includes the twelfth aspect, where the extractor comprises a temperature controller to control the temperature of an internal fluid.

A fourteenth aspect of the disclosure includes any of the twelfth through thirteenth aspects, where the extractor has an internal fluid temperature of from 50° C. to 250° C.

A fifteenth aspect of the disclosure includes any of the twelfth through fourteenth aspects, where the extractor comprises an internal mixing device.

A sixteenth aspect of the disclosure includes the fifteenth aspect, where the internal mixing device is a rotating agitator having anchor-type blades.

A seventeenth aspect of the disclosure includes any of the twelfth through sixteenth aspects, where the paraffinic and the heavy fraction are combined in the extractor for a residence time of from 1 minute to 8 hours.

An eighteenth aspect of the disclosure includes any of the twelfth through seventeenth aspects, where the paraffinic fraction and the heavy fraction are combined in the extractor for a residence time of at least from 10 minutes to 30 minutes.

A nineteenth aspect of the disclosure includes any of the first through eighteenth aspects, where the gas fraction is passed to a caustic treatment unit to produce fuel gas.

A twentieth aspect of the disclosure includes any of the first through nineteenth aspects, where the hydrocarbon-based composition comprises atmospheric residue, vacuum residue, or combinations thereof.

A twenty-first aspect of the disclosure relates to a process according to any of the first through twentieth aspects, further comprising passing the paraffinic fraction to a distillation unit to produce at least a light paraffinic fraction and a heavy paraffinic fraction and combining the light paraffinic fraction with the heavy fraction to produce the deasphalted oil fraction.

A twenty-second aspect of the disclosure includes the twenty-first aspect, where the light paraffinic fraction is combined with the heavy fraction in an extractor.

A twenty-third aspect of the disclosure includes the twenty-second aspect, where the extractor comprises a temperature controller to control the temperature of an internal fluid.

A twenty-fourth aspect of the disclosure includes the twenty-second or twenty-third aspects, where the extractor has an internal fluid temperature of from 50° C. to 250° C.

A twenty-fifth aspect of the disclosure includes any of the twenty-second through twenty-fourth aspects, where the extractor comprises an internal mixing device.

A twenty-sixth aspect of the disclosure includes the twenty-fifth aspect, where the internal mixing device is a rotating agitator having anchor-type blades.

A twenty-seventh aspect of the disclosure includes any of the twenty-second through twenty-sixth aspects, where the paraffinic and the heavy fraction are combined in the extractor for a residence time of from 1 minute to 8 hours.

A twenty-eighth aspect of the disclosure includes any of the twenty-second through twenty-seventh aspects, where the paraffinic and the heavy fraction are combined in the extractor for a residence time of at least from 10 minutes to 30 minutes.

A twenty-ninth aspect of the disclosure is directed to a process for producing deasphalted oil comprising: combining a supercritical water stream with a pressurized, heated hydrocarbon-based composition in a mixing device to create a combined feed stream; introducing the combined feed stream into a supercritical reactor, where the supercritical reactor operates at a temperature greater than a critical temperature of water and a pressure greater than a critical pressure of water, to produce an upgraded product; depressurizing the upgraded product; separating the depressurized upgraded product into at least one light and at least one heavy fraction, where the heavy fraction has a greater concentration of asphaltene than the light fraction; passing the light fraction to an oil/water separator to produce a dewatered light fraction and a water fraction; passing the dewatered light fraction to a distillation unit to separate the dewatered light fraction into at least one gas fraction, one dewatered paraffinic fraction, and one dewatered heavy oil fraction; and combining the dewatered paraffinic fraction with the heavy fraction to produce at least one deasphalted oil fraction.

A thirtieth aspect of the disclosure includes the twenty-ninth aspect, where hydrocarbons in the light fraction have an API gravity value that is greater than hydrocarbons in the heavy fraction.

A thirty-first aspect of the disclosure includes any of the twenty-ninth through thirtieth aspects, where the heavy fraction has a 25% greater concentration of asphaltene than the light fraction.

A thirty-second aspect of the disclosure includes any of the twenty-ninth through thirty-first aspects, where the heavy fraction has a 75% greater concentration of asphaltene than the light fraction.

A thirty-third aspect of the disclosure includes any of the twenty-ninth through thirty-second aspects, where the heavy fraction has a greater boiling point than the light fraction.

A thirty-fourth aspect of the disclosure includes any of the twenty-ninth through thirty-third aspects, where hydrocarbons in the light fraction have an API gravity value of greater than or equal to 30° and hydrocarbons in the heavy fraction have an API gravity value of less than 30°.

A thirty-fifth aspect of the disclosure includes any of the twenty-ninth through thirty-fourth aspects, where hydrocarbons in the heavy fraction have an API gravity value of less than 30° and greater than or equal to 20°.

A thirty-sixth aspect of the disclosure includes any of the twenty-ninth through thirty-fifth aspects, where the dewatered light fraction has a water content of less than or equal to 1 wt % water.

A thirty-seventh aspect of the disclosure includes any of the twenty-ninth through thirty-sixth aspects, where the dewatered light fraction has a water content of less than or equal to 0.5 wt % water.

A thirty-eighth aspect of the disclosure includes any of the twenty-ninth through thirty-seventh aspects, where the dewatered light fraction has a water content of less than or equal to 0.1 wt % water.

A thirty-ninth aspect of the disclosure includes any of the twenty-ninth through thirty-eighth aspects, where the dewatered light fraction has a viscosity of less than or equal to 380 centistokes (cSt).

A fortieth aspect of the disclosure includes any of the twenty-ninth through thirty-ninth aspects, where the dewatered light fraction has a viscosity of less than or equal to 180 cSt.

A forty-first aspect of the disclosure includes any of the twenty-ninth through fortieth aspects, further comprising cooling the upgraded product before the depressurizing step.

A forty-second aspect of the disclosure includes any of the twenty-ninth through forty-first aspects, further comprising passing the water fraction to a water treatment unit to produce a feed water fraction.

A forty-third aspect of the disclosure includes any of the twenty-ninth through forty-second aspects, where separating the depressurized upgraded product comprises passing the depressurized upgraded product to at least one distillation unit.

A forty-fourth aspect of the disclosure includes any of the twenty-ninth through forty-third aspects, where separating the depressurized upgraded product comprises passing the depressurized upgraded product to a flash drum.

A forty-fifth aspect of the disclosure includes any of the twenty-ninth through forty-fourth aspects, where the dewatered paraffinic fraction and the heavy fraction are combined in an extractor.

A forty-sixth aspect of the disclosure includes the forty-fifth aspect, where the extractor comprises a temperature controller to control the temperature of an internal fluid.

A forty-seventh aspect of the disclosure includes any of the forty-fifth or forty-sixth aspects, where the extractor has an internal fluid temperature of from 50° C. to 250° C.

A forty-eighth aspect of the disclosure includes any of the forty-fifth through forty-seventh aspects, where the extractor comprises an internal mixing device.

A forty-ninth aspect of the disclosure includes the forty-eighth aspect, where the internal mixing device is a rotating agitator having anchor-type blades.

A fiftieth aspect of the disclosure includes any of the twenty-ninth through forty-ninth aspects, where the dewatered paraffinic and the heavy fraction are combined in the extractor for a residence time of from 1 minute to 8 hours.

A fifty-first aspect of the disclosure includes any of the twenty-ninth through fiftieth aspects, where the dewatered paraffinic and the heavy fraction are combined in the extractor for a residence time of from 10 minutes to 30 minutes.

A fifty-second aspect of the disclosure includes any of the twenty-ninth through fifty-first aspects, where the deasphalted fraction is passed to a product tank and combined with the dewatered heavy oil fraction to produce an oil product.

A fifty-third aspect of the disclosure includes any of the twenty-ninth through fifty-second aspects, where the gas fraction is passed to a caustic treatment unit to produce fuel gas.

It should be apparent to those skilled in the art that various modifications and variations may be made to the embodiments described within without departing from the spirit and scope of the claimed subject matter. Thus, it is intended that the specification cover the modifications and variations of the various embodiments described within provided such modification and variations come within the scope of the appended claims and their equivalents.

As used throughout, the singular forms "a," "an" and "the" include plural referents unless the context clearly dictates otherwise. Thus, for example, reference to "a" component includes aspects having two or more such components, unless the context clearly indicates otherwise.

Having described the subject matter of the present disclosure in detail and by reference to specific embodiments thereof, it is noted that the various details disclosed within should not be taken to imply that these details relate to elements that are essential components of the various embodiments described within, even in cases where a particular element is illustrated in each of the drawings that accompany the present description. Further, it should be apparent that modifications and variations are possible without departing from the scope of the present disclosure, including, but not limited to, embodiments defined in the appended claims. More specifically, although some aspects of the present disclosure are identified as particularly advantageous, it is contemplated that the present disclosure is not necessarily limited to these aspects

What is claimed is:

1. A process for producing deasphalted oil, the process comprising:

combining a supercritical water stream with a pressurized, heated hydrocarbon-based composition in a mixing device to create a combined feed stream;

introducing the combined feed stream into a supercritical reactor, where the supercritical reactor operates at a temperature greater than a critical temperature of water and a pressure greater than a critical pressure of water, to produce an upgraded product;

depressurizing the upgraded product;

separating the depressurized upgraded product into at least one light and at least one heavy fraction, in which the heavy fraction has a greater concentration of asphaltene than the light fraction;

passing the light fraction to a separator to separate the light fraction into at least one gas fraction, one paraffinic fraction, and one water fraction;

passing the paraffinic fraction to a distillation unit to produce at least a light paraffinic fraction and a heavy paraffinic fraction, where a true boiling point of 80% of the light paraffinic fraction is less than 200° C.; and combining the light paraffinic fraction with the heavy fraction to remove asphaltene and thereby produce deasphalted oil.

2. The process of claim 1, where the heavy fraction has at least a 25% to 75% greater concentration of asphaltene than the light fraction.

3. The process of claim 1, where hydrocarbons in the light fraction have an American Petroleum Institute (API) gravity value of greater than or equal to 30° and hydrocarbons in the heavy fraction have an API gravity value of less than 30°.

4. The process of claim 1, further comprising passing the water fraction to a water treatment unit to produce a feed water fraction.

5. The process of claim 1, where separating the depressurized upgraded product comprises passing the depressurized upgraded product to at least one distillation unit or flash drum.

6. The process of claim 1, where combining the light paraffinic fraction and the heavy fraction is performed using an extractor.

7. The process of claim 6, where the extractor comprises a temperature controller to control the temperature of an internal fluid to a temperature of from 50° C. to 250° C.

8. The process of claim 1, where the gas fraction is passed to a caustic treatment unit to produce fuel gas.

9. The process of claim 1, where the paraffinic fraction comprises at least 80 vol % paraffins.

10. A process for producing deasphalted oil comprising:

combining a supercritical water stream with a pressurized, heated hydrocarbon-based composition in a mixing device to create a combined feed stream;

introducing the combined feed stream into a supercritical reactor, where the supercritical reactor operates at a temperature greater than a critical temperature of water and a pressure greater than a critical pressure of water, to produce an upgraded product;

depressurizing the upgraded product;

separating the depressurized upgraded product into at least one light and at least one heavy fraction, where the heavy fraction has a greater concentration of asphaltene than the light fraction;

passing the light fraction to an oil/water separator to produce a dewatered light fraction and a water fraction;

passing the dewatered light fraction to a distillation unit to separate the dewatered light fraction into at least one gas fraction, one dewatered paraffinic fraction, and one dewatered heavy oil fraction, where a true boiling point of 80% of the dewatered paraffinic fraction is less than 200° C.; and combining the dewatered paraffinic fraction with the heavy fraction to produce at least one deasphalted oil fraction.

11. The process of claim 10, where hydrocarbons in the light fraction have an API gravity value that is greater than hydrocarbons in the heavy fraction.

12. The process of claim 10, where the heavy fraction has at least a 25% to 75% greater concentration of asphaltene than the light fraction.

13. The process of claim 10, where hydrocarbons in the light fraction have an API gravity value of greater than or equal to 30° and hydrocarbons in the heavy fraction have an API gravity value of less than 30°.

14. The process of claim 10, where the dewatered light fraction has a water content of less than or equal to 1 wt % water.

15. The process of claim 10, where the dewatered light fraction has a viscosity of less than or equal to 380 centistokes (cSt).

16. The process of claim 10, further comprising passing the water fraction to a water treatment unit to produce a feed water fraction.

17. The process of claim 10, where separating the depressurized upgraded product comprises passing the depressurized upgraded product to at least one distillation unit or flash drum.

18. The process of claim 10, where the dewatered paraffinic fraction and the heavy fraction are combined in an extractor.

19. The process of claim 18, where the extractor comprises a temperature controller to control the temperature of an internal fluid to a temperature of from 50° C. to 250° C.

20. The process of claim 10, where the deasphalted fraction is passed to a product tank and combined with the dewatered heavy oil fraction to produce an oil product.

21. The process of claim 10, where the gas fraction is passed to a caustic treatment unit to produce fuel gas.

22. The process of claim 10, where the dewatered paraffinic fraction comprises at least 80 vol % paraffins.

* * * * *